United States Patent [19]

Miller

[11] 4,077,355

[45] Mar. 7, 1978

[54] CYLINDER STRIPING DEVICE

[76] Inventor: Vincent P. Miller, Miller Pottery Engineering Company, 2300 Palmer St., Pittsburgh, Pa. 15218

[21] Appl. No.: 693,308

[22] Filed: Jun. 7, 1976

Related U.S. Application Data

[63] Continuation of Ser. No. 555,023, Mar. 3, 1975, abandoned.

[51] Int. Cl.[2] ..... B05C 1/02

[52] U.S. Cl. ..... 118/219; 118/223; 118/225; 118/230; 118/233; 118/262

[58] Field of Search ..... 118/218, 219, 232, 233, 118/258, 259, 230, 262, 223, 211, 224, 225; 101/263, 38 R, 38 A, 37, 40

[56] References Cited

U.S. PATENT DOCUMENTS

| | | | |
|---|---|---|---|
| 2,158,495 | 5/1939 | Crighton et al. | 118/259 |
| 2,495,174 | 1/1950 | McClatchie | 118/230 X |
| 2,647,489 | 8/1953 | Ryckman | 118/219 |
| 2,836,145 | 5/1958 | Becker | 118/233 X |
| 3,251,707 | 5/1966 | Blawk et al. | 118/218 X |
| 3,261,734 | 7/1966 | Long | 101/38 R X |
| 3,405,633 | 10/1968 | Price, Jr. et al. | 101/37 |
| 3,680,479 | 8/1972 | Nichols et al. | 101/38 R |
| 3,789,754 | 2/1974 | Shofner et al. | 101/363 X |

*Primary Examiner*—John P. McIntosh
*Attorney, Agent, or Firm*—Wm. Henry Venable

[57] ABSTRACT

My invention relates to the method and apparatus for printing stripe patterns on the outside surface of cylindrical objects such as glass tumblers with their axes vertical during the printing operation, the stripes being printed substantially circularly about the axis of the cylinder as the center. The cylinder being striped is supported at a printing station for free rotation about its vertical axis. A stripe printing head provided with a stripe printing roller and an ink applicator drum, both rotating about substantially vertical axes, is moved to bring the printing roller in tangential printing contact with the tumbler surface. The printing head includes an enclosed ink (or pigment) supply well adjacent a segment of the perimeter of the applicator drum and means for maintaining the supply well full from a supply reservoir.

7 Claims, 30 Drawing Figures

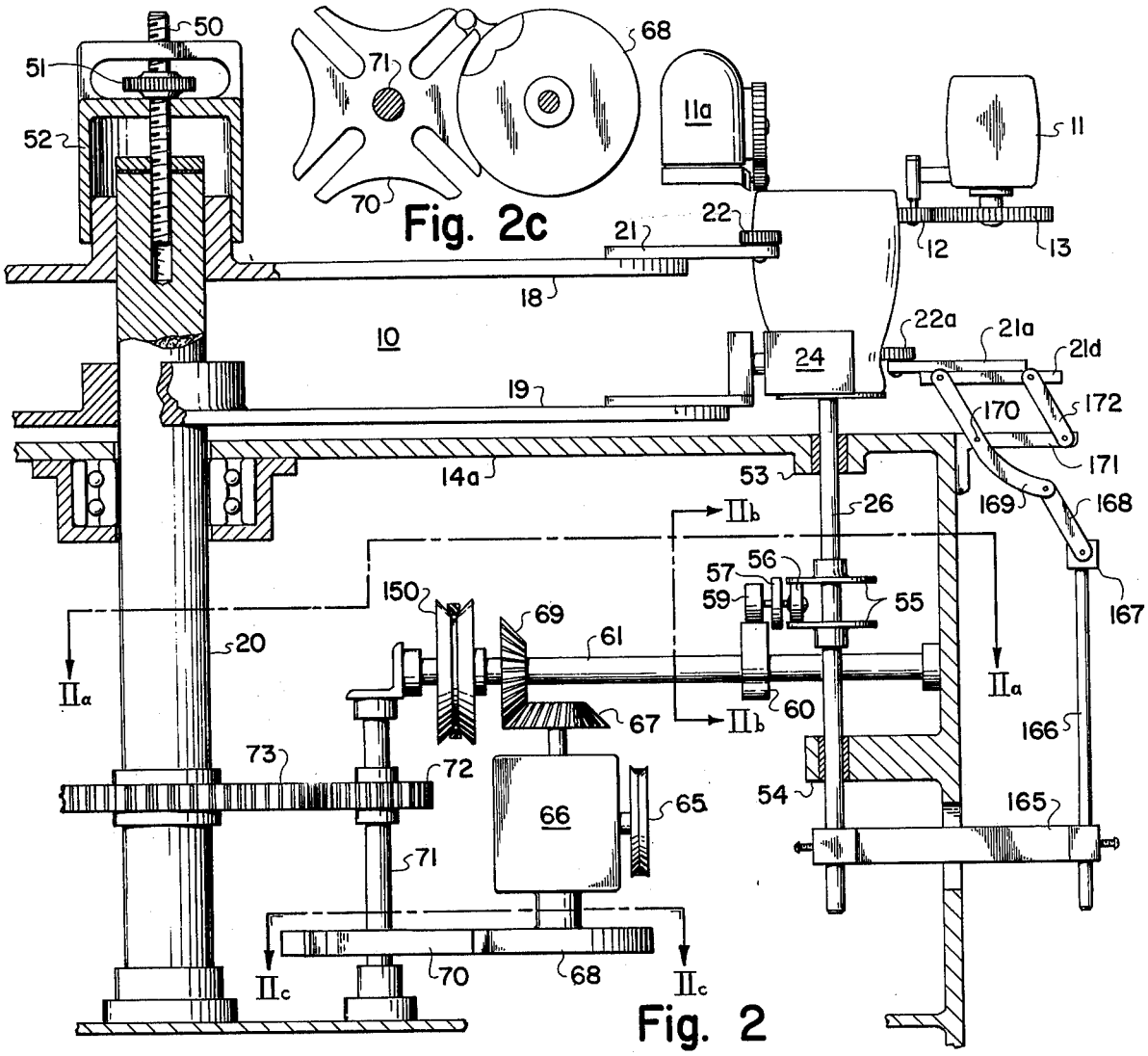
Fig. 2c
Fig. 2
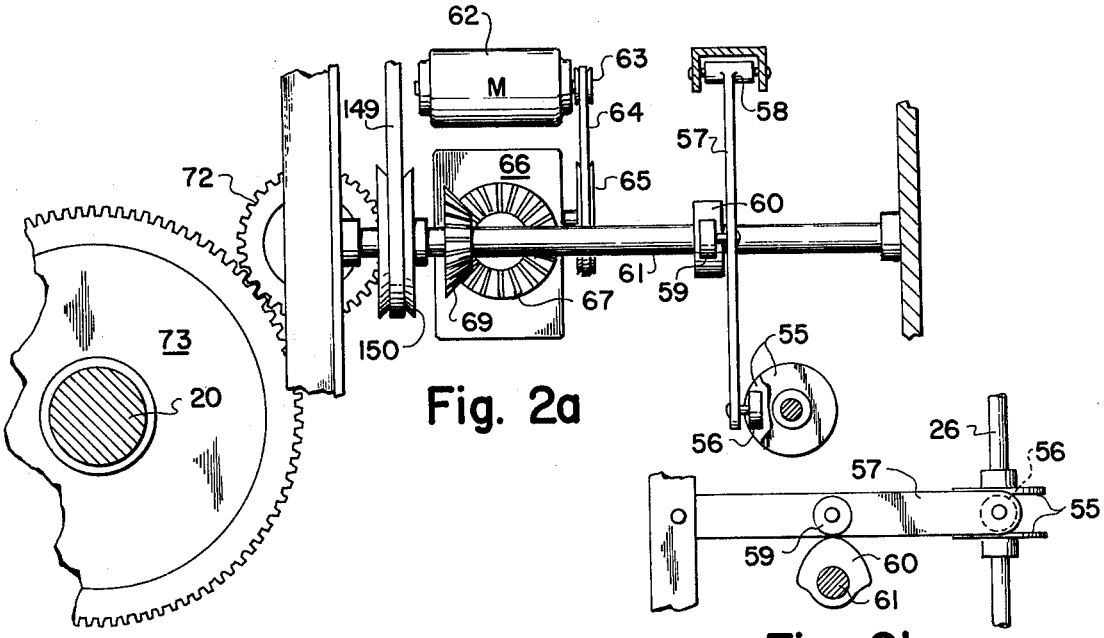
Fig. 2a
Fig. 2b

CYLINDER STRIPING DEVICE

CROSS REFERENCE TO RELATED APPLICATION

This patent application is a continuation of my application Ser. No. 555,023 filed Mar. 3, 1975, of the same title now abandoned.

BACKGROUND OF THE INVENTION

The art of decorating glass tumblers or the like before firing for glazing, prior to my invention, is exemplified by Ryckman U.S. Pat. No. 2,649,487 issued Aug. 4, 1953 entitled Machine for Applying Precious Metal Decorative Bands to Glass Tumblers, and Blank et al. U.S. Pat. No. 3,251,707 issued May 17, 1966 entitled Method and Apparatus for Decorating Glassware. The Ryckman patent teaches one skilled in the art a technique for applying stripes to the lateral walls of tumblers; the Blank et al. patent teaches a technique for banding the rims only of tumblers. Both Ryckman's and Blank et al.'s teaching require that the surface to which pigment is applied is substantially horizontal (the lateral wall of the tumblers in Ryckman, the tumbler rims in Blank et al.), under the pigment applying members (rollers 26 in Ryckman, belts 52, 53 in Blank et al.), and both teachings specify an open-type pigment reservoir (item 30 in Ryckman, FIG. 7; item 85 in Blank et al., FIG. 4). Thus while Blank et al bands the rims of tumblers in erect position, it is impossible with that device to stripe the lateral walls, which are vertical surfaces; and the necessity of mounting the tumblers in chucks with their axes horizontal in the Ryckman teaching inherently involves manual handling of the tumblers from supply conveyors (such as item 10 in Blank et al.) to insert and remove them from the chucks. Thus there was a longstanding unsolved problem of providing means for automatically striping the lateral walls of vertical tumblers, and optionally simultaneously banding the rims thereof, which was finally solved by my inventin as disclosed and claimed in this application.

BRIEF SUMMARY OF THE INVENTION

My invention relates to apparatus for printing stripes on the outside surface of cylindrical work pieces such as glass or ceramic tumblers, with their axes vertical during the printing step. This apparatus is of the general type characterized by a stripe printing head mounted on the forward end of a tubular driving arm which extends from a remotely located headmount in which the driving arm is pivotally mounted and operated to move the printing head from and to stripe printing contact with the tumblers. Heretofore it has not been possible to apply circumferential stripes to cylindrical work pieces without having them mounted with their axes substantially horizontal in a rotatable chuck. My invention renders this unnecessary and greatly facilitates the handling of tumblers from and to a conveyor and substantially increases the rate of production.

To accomplish this I have devised a new stripe printing head in which the stripe printing and pigment applicator drum rotate about vertical axes, or axes substantially inclined to the horizontal, such that the stripe printing roller tangentially contacts the surface of cylinders positioned erect vertically. Generally speaking, tumblers are not precise cylinders, but are contoured from the base to the rim such that the surface at the striping zone may be inclined to the vertical, and my printing head is adjustable to be correspondingly inclined so that it contacts the surface tangentially across the entire width of the striping roller. In place of the open pigment well, of the prior art, I have devised a reservoir block totally enclosing the pigment pick-up segment of the applicator drum, which is filled by a sealed connection from an enclosed supply tank.

To bring the stripe printing roller into such tangential contact with the work piece at the precise desired distance from its base, and to provide adjustable resilient pressure of the roller against the surface of the work piece, I have devised a novel headmount for the driving arm remote from the printing station. The end of the driving arm is anchored in a universal pivot in this headmount. Forward of this pivot the driving arm is supported from below by a generally horizontal track on a yoke in the headmount adjustable about a horizontal axis, whereby the level of the track may be set. Fulcrumed on this yoke is a guiding arm positioning lever resiliently connected to the driving arm forward of the pivot. This lever is operated to move the driving arm along the track, in one direction bringing the printing head in printing contact with the work piece, and in the other direction removing it from contact with the work piece. My invention includes means for operating this lever in adjustable and precise timing so that the printing roller will contact the work piece during only whatever number of revolutions thereof may be predetermined. This means for operating the lever, and the drive for printing mechanism shaft extending from the head through the driving arm to behind the headmount, are contained in a housing in a vertical panel of which the headmount assembly is adjustably mounted.

My invention further includes a novel work-transferring and position indexing dial arrangement by which tumblers or the like may be handled in succession from and to a conveyor, each tumbler being indexed and mounted for free rotation at a stripe printing station. This indexing dial is constructed of two circular, parallel disks rotated intermittently above a work piece supporting table about a common vertical axis. At spaced intervals on the circumference of the upper disk are guide roller brackets for positioning the work pieces near their rims, and at spaced intervals on the circumference of the lower disk are stall brackets positioning the work pieces near their bottoms. As the dial rotates, the work pieces glide over the supporting table, being guided by the stalls, to and from one or more stripe printing stations at which means are provided to raise the work pieces from the table into free-rotatable position. The operation of the dial and the headmount for the printing head driving arm are synchronized so that tumblers or the like are automatically striped in succession. The relative position of the axis of the dial with respect to the headmount and the length of the driving arm is constructed so that the driving arm approaches the work piece in a direction substantially along a radius of the dial at the stripe printing station or stations. When more than one striping station is provided, the printing operation is simultaneously performed at all of these stations.

BRIEF DESCRIPTIN OF THE DRAWINGS

In the annexed drawings illustrating the embodiment of my invention,

FIG. 1 is an isometric view of the general arrangement of the apparatus as seen by the operator;

FIG. 1*a* is a diagrammatic plan view of a variation of the general arrangement in FIG. 1;

FIG. 2 is an elevation, partially in section, at the work station of the apparatus illustrating one embodiment;

FIGS. 2*a*, 2*b* and 2*c* are sections at the planes indicated by the section lines IIa—IIa, IIb—IIb and IIc—IIc on FIG. 2;

FIG. 2*d* is a vertical sectional view at the work station illustrating another embodiment of this invention.

Figure 1:
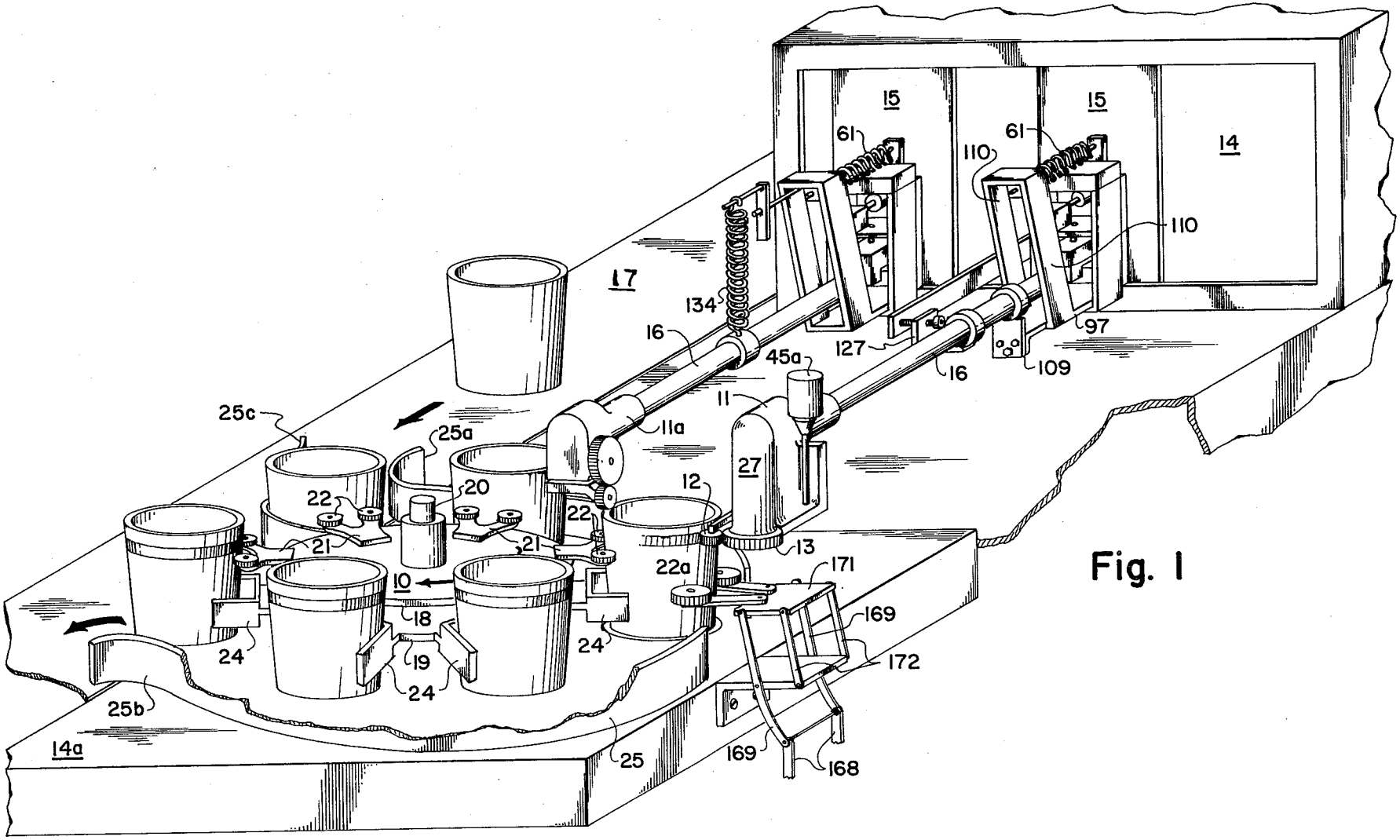
Figure 10:
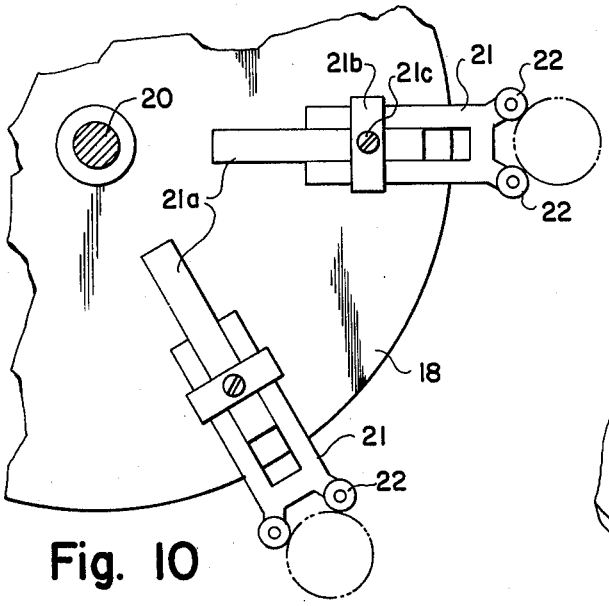
Figure 11:
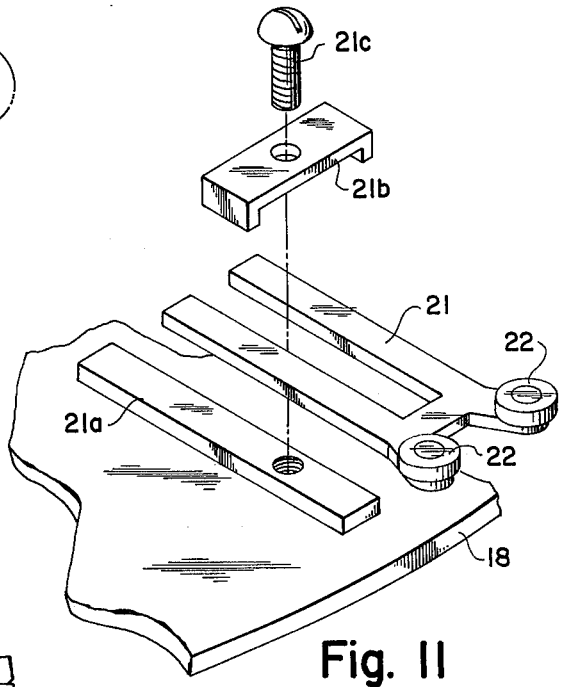
Figure 12:
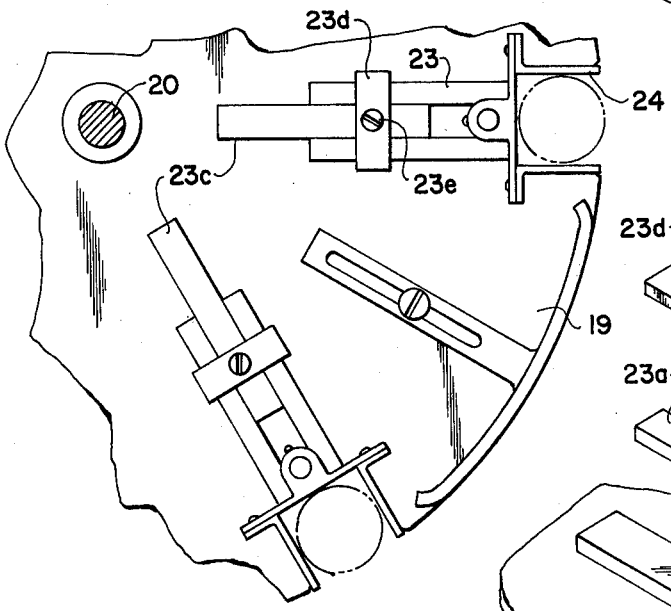
Figure 13:
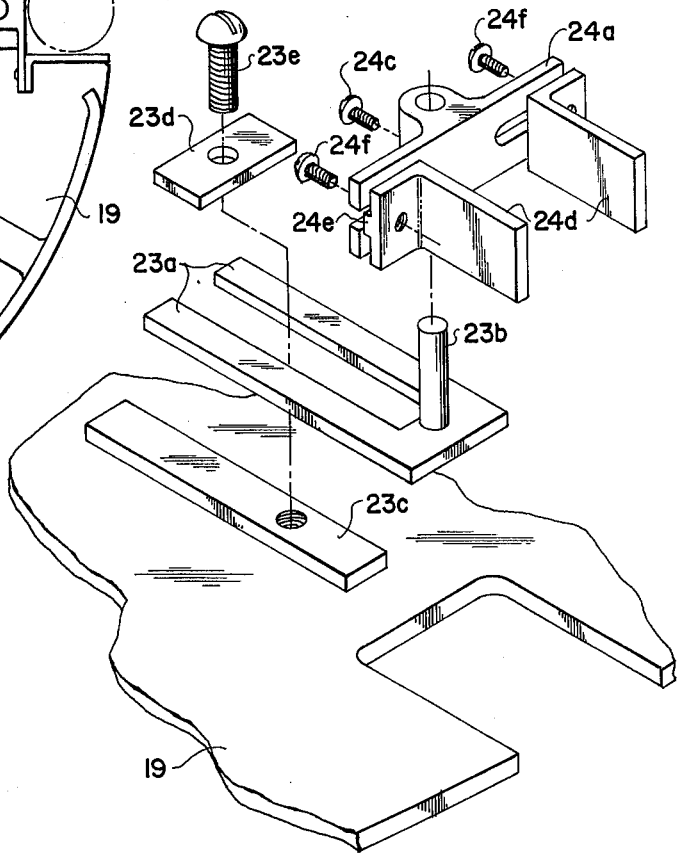

FIGS. 10, 11, 12 and 13 further illustrate the construction of the dial plates 18 and 19 generally shown in FIGS. 1 and 2; FIG. 10 is a plan view of a segment of the upper dial plate 18 and FIG. 11 is an exploded view of the mounting of the adjustable roller brackets thereon; FIG. 12 is a plan view of a segment of the lower dial plate 19 and FIG. 13 is an exploded view of the mounting of the adjustable stalls thereon.

Figure 14:
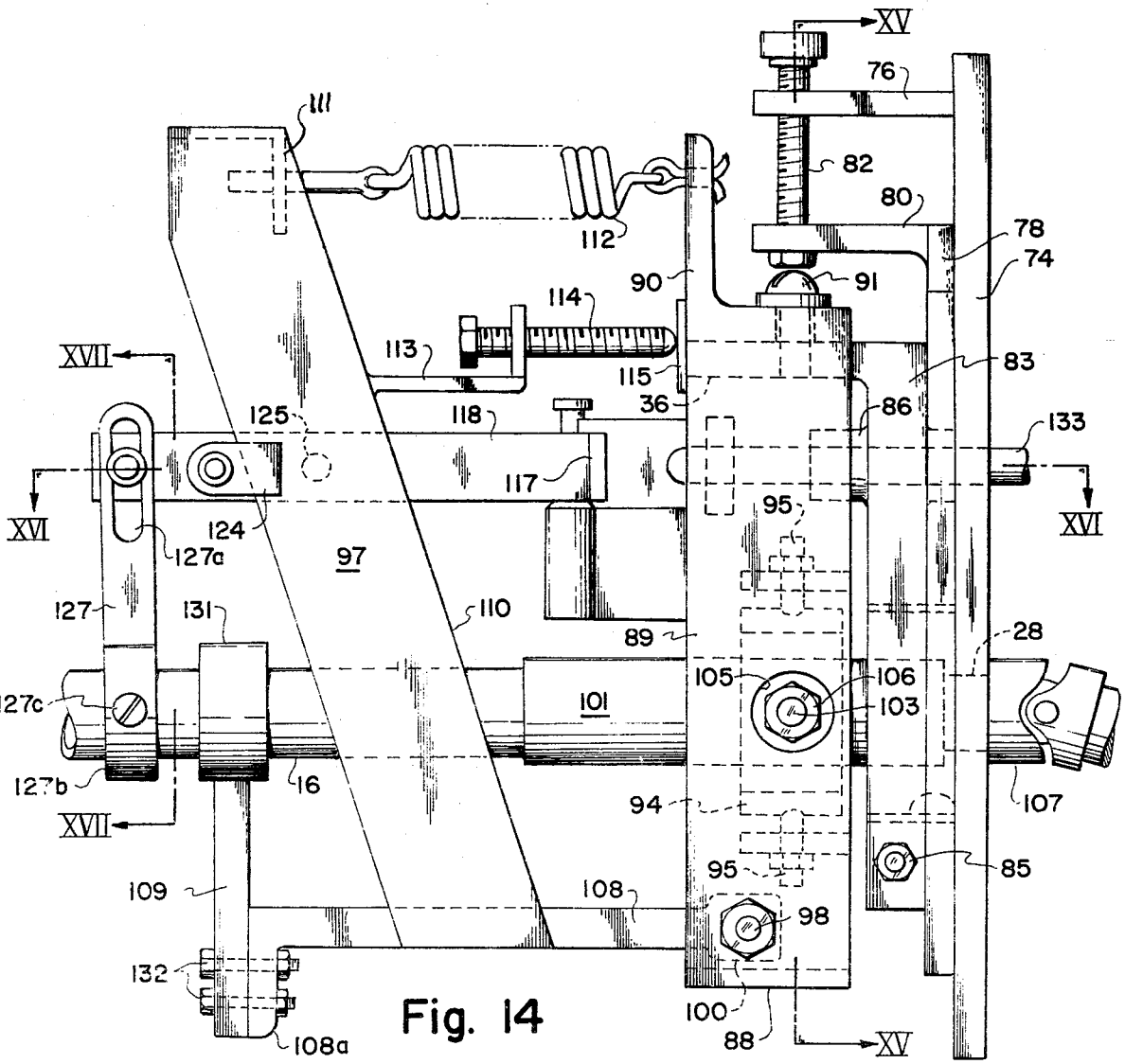
Figure 15:
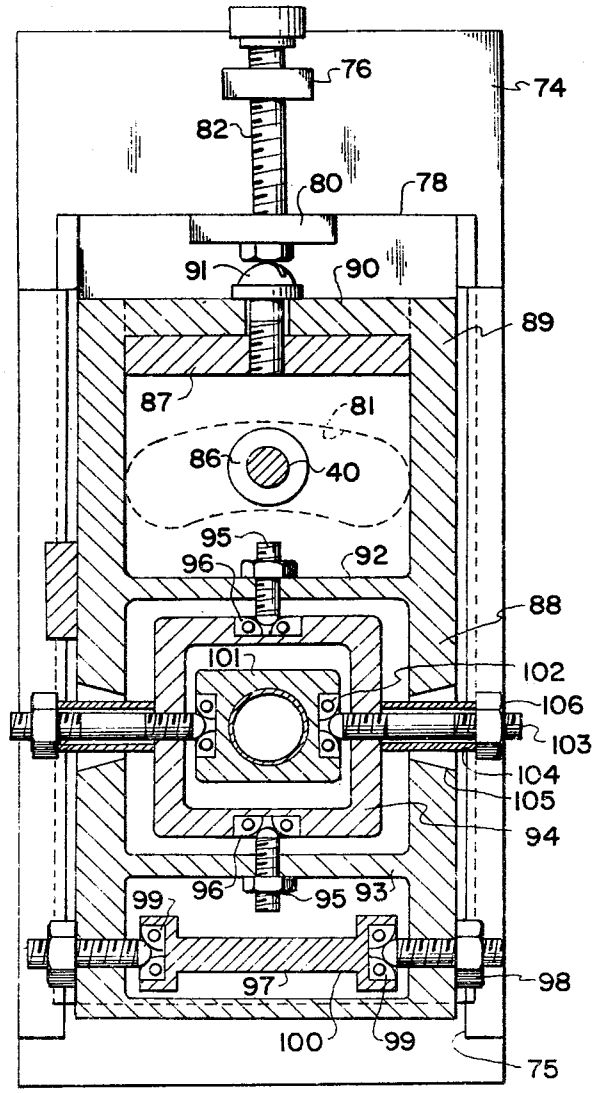
Figures 16, 17, 17A, 18, 19:
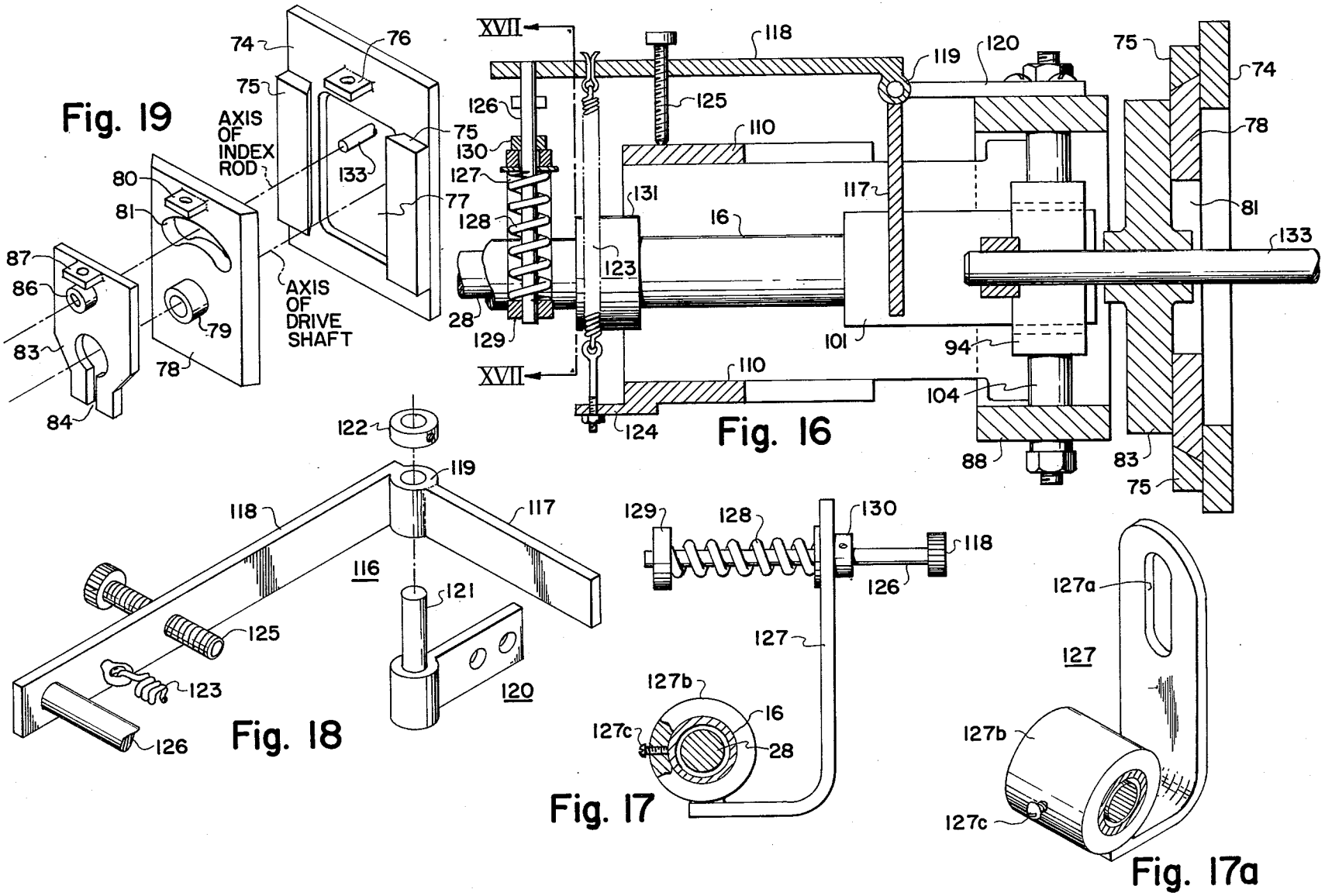

FIGS. 14 through 20 illustrate the construction of the headmounts generally indicated by the reference numeral 15 in FIG. 1;

FIG. 14 is a side view of the headmount, and FIGS. 15 and 16 are sections therethrough at the planes indicated by lines XV—XV and XVI—XVI, respectively;

FIG. 17 illustrates the mounting of the driving-arm connecting bracket on the headmount lever and FIG. 17*a* is an isometric view of the bracket alone;

FIG. 18 is an isometric, exploded view of the headmount lever 116 and the fulcrum bracket on which it is assembled;

FIG. 19 is an exploded view in perspective of three headmount components, and

Figure 20:
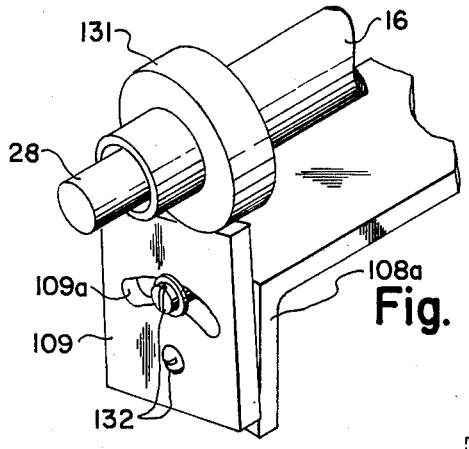

FIG. 20 is an isometric view of the driving arm roller and track therefor at the headmount.

Figure 22:
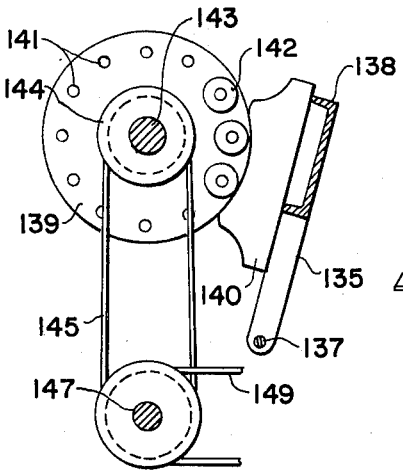
Figure 21:
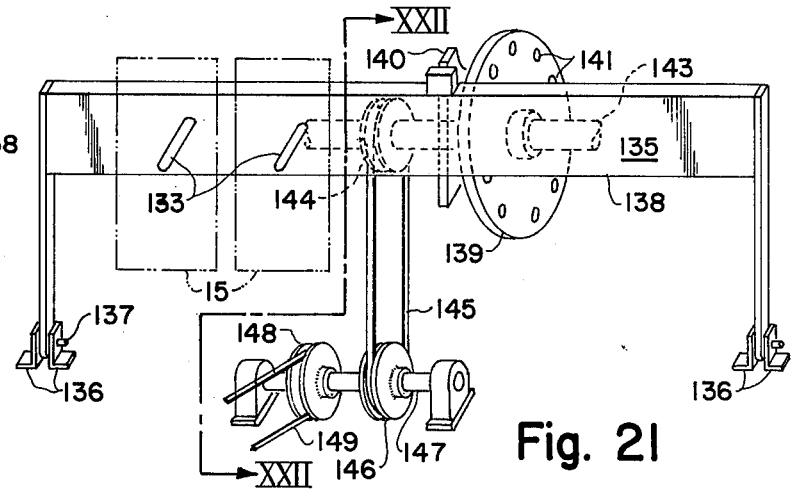

FIG. 21 is a partial perspective view showing the mechanism for thrusting the headmount push-rods, and FIG. 22 is a vertical section at the plane XXII—XXII in FIG. 21.

Figure 23:
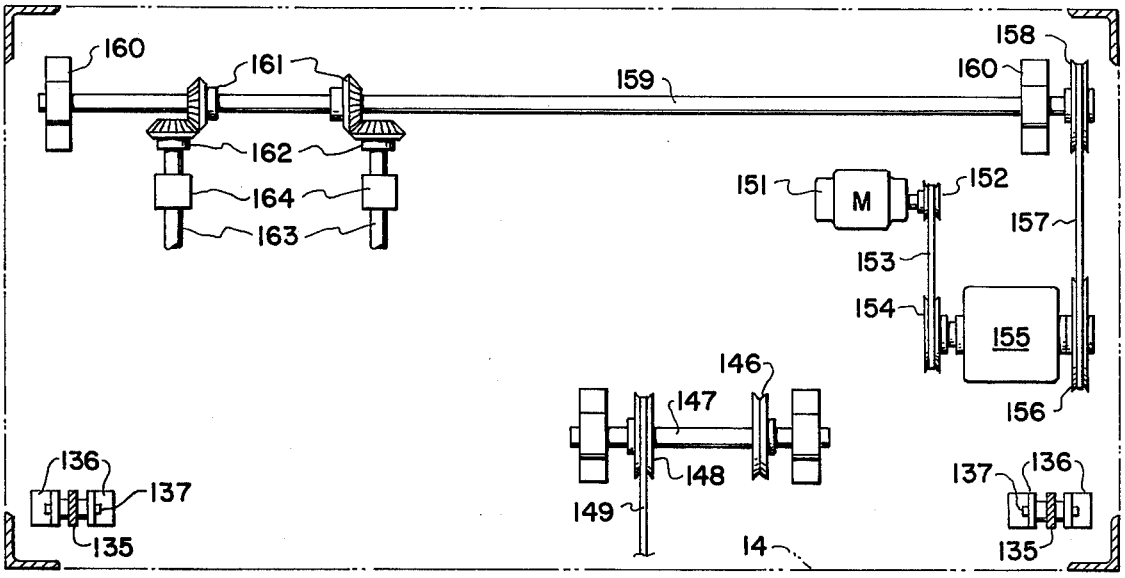

FIG. 23 is a horizontal section through the housing behind the headmounts, looking downward towards the driving mechanism.

DETAILED DESCRIPTION

The general arrangement of an embodiment of my invention is shown in FIG. 1, in the foreground of which appears a work indexing dial 10 by which tumblers are brought in vertical, erect position to a striping station at the right where a printing head 11 applies circumferential bands to the cylindrical wall, and optionally, another printing head 11a simultaneously applies a band to the rim.

The apparatus illustrated generally corresponds to an experimental, pilog installation on which many successful trial runs have been made. The rim-banding head therein is substantially like the head with applicator drum and printing roller illustrated and described in the Ryckman patent cited, and is therefore not described in detail in this disclosure. The circumferential-banding head 11 includes novel improvements of the present invention, subsequently described, which make it possible to apply stripes to substantially vertical surfaces.

FIG. 1 thus illustrates the apparatus during the rim-banding and circumference-striping operation, after which the head 11 moves to the right and the head 11a is raised and the dial 10 removes the finished tumbler and places another one in indexed, printing position. My experimental, pilot plant installation was operated at the rate of 30 tumblers per minute, i.e., one tumbler striped in two seconds, of which approximately 75% was dwell time for the printing, the remaining 25% being for indexing and raising the tumbler for free rotation. In this installation, as illustrated in FIG. 1, the dial 10 had 6 stalls for tumblers and the striping was performed at only one position of the stalls, the dial rotating 60° between stops.

Figure 1A:
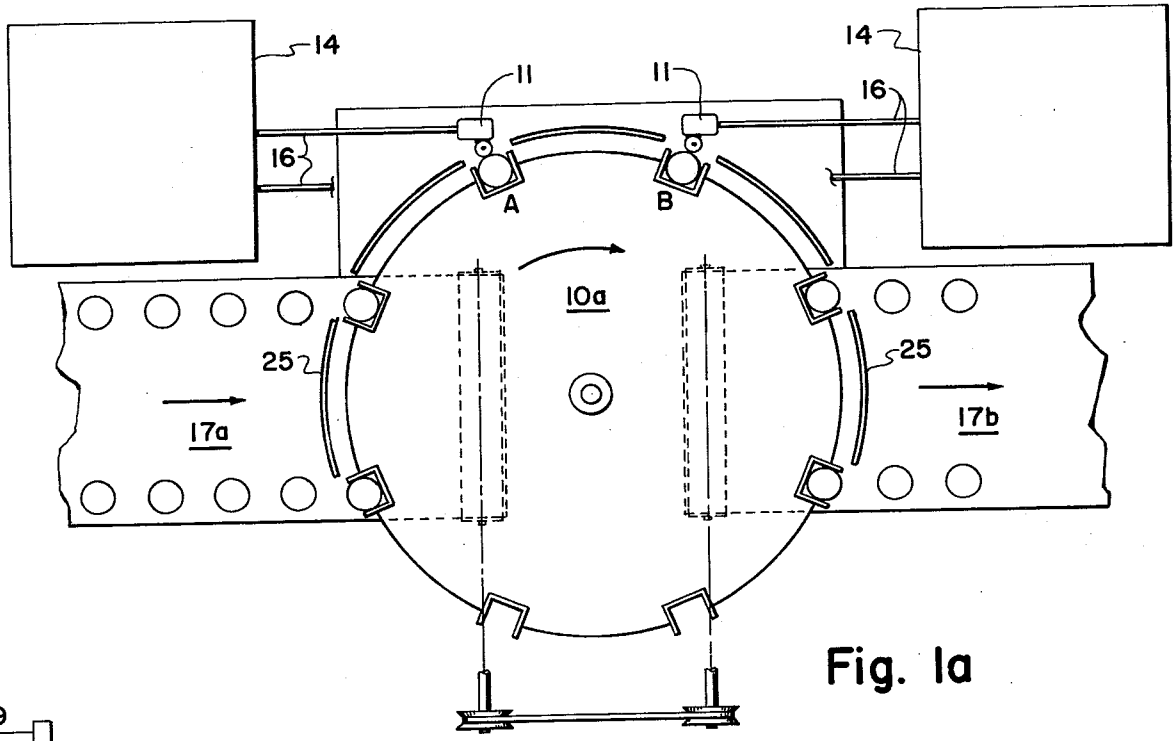
Figure 7:
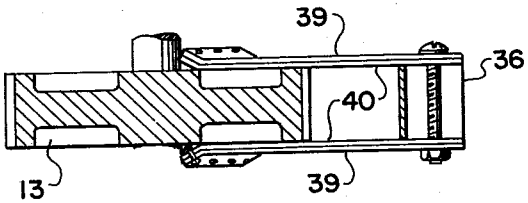
FIG. 7 is a vertical section at the plane indicated by VII—VII in FIG. 6.

FIG. 1a diagrammatically illustrates an embodiment of my invention when the striping is performed simultaneously at two stalls of the dial 10, at the positions A and B. The two heads 11 may apply different stripes on the same tumbler with this arrangement, the dial 10 rotating 45° between stops, thus doubling the amount of work performed on the tumbler at the rate of 30 per minute, or the dial 10 may rotate 90° between stops delivering unstriped tumblers to both positions A and B where the same striping operation is performed by both heads 11, in which the production would be doubled to 60 per minute.

In the background of FIG. 1, one sees the face of a generally vertical front panel 14 of the housing behind which is assembled the driving transmission, universal shafts, cams, speed reducers, etc., which operate the printing heads. Assembled in this panel 14 are seen two headmounts 15 which support and control the forwardly extending driving arms 16 which terminate in the circumference-striping head 11 and rim-banding head 11a. The construction of these headmounts 15 and associated apparatus controlling their operation in cycles synchronized with the dial 10 is illustrated in other figures and will be described subsequently.

The indexing dial assembly 10 seen in the foreground of FIG. 1 is adjacent a conveyor belt 17 by which blank cylindrical work pieces are delivered to, and banded work pieces are removed from, the dial assembly. The surface of the belt 17 is substantially flush with the table 14a above which the dial assembly is rotatably mounted and over which the work pieces glide as they are moved to and from the striping station.

For the two striping position embodiment, I prefer to provide two conveyors 17*a* and 17*b* as illustrated in FIG. 1*a*, generally aligned on each side of the dial 10, and travelling in the same direction. The dial 10 in this embodiment has eight stalls instead of six as in the FIG. 1 embodiment. These conveyors 17*a* and 17*b* are wide enough to deliver and remove two rows of tumblers, the left hand conveyor 17*a* supplying tumblers to two stalls on one side of the dial and the right hand conveyor 17*b* removing tumblers from the two stalls on the opposite side. Assuming a 90° rotation of the dial at each step, the tumblers are striped in pairs at work stations A and B, the two stalls filled by conveyor 17*a* rotating to the work stations and the striped tumblers are removed when the two stalls pass to conveyor 17*b*.

As seen in FIGS. 1 and 2, the indexing dial assembly is comprised of two circular dial plates 18 and 19 mounted on a vertical shaft 20 extending through the table 14*a*. A series of radially-adjustable brackets 21 on which are mounted pairs of guide rollers 22 abutting the side of the cylindrical work pieces opposite to the printing roller 12, are assembled about the circumference of the upper dial plate 18. On the lower dial plate 19 in vertical registry with the guide roller brackets 21, are assembled a series of adjustable brackets 23 on which are mounted U-shaped stalls 24 which embrace three sides of the work pieces near the bottom thereof. A railing 25, mounted on the table 14*a*, extends around the dial assembly 10 and provides the fourth, or closing, side of the stalls for the work pieces. This railing 25 has an entry section 25*a* extending over the conveyor belt 17 at the feed end and an exit section 25*b* extending over the belt at the discharge end. Opposite the railing sections 25*a* and 25*b* are curved guide rails 25*c*, forming feed and delivery channels for the work pieces. The railing 25 does not extend across the work station, where there is a gap therein for entry of a pair of work-centering indexing rollers 22*a* on the side of the work piece opposite the guide rollers 22 and stalls 24.

The U-shaped stalls are adjustable in size to match any of a variety of sizes of cylinders, as illustrated in FIG. 13, subsequently described.

Referring still to FIGS. 1 and 2, at the striping station each work piece is automatically raised from the table 14*a* by a vertically extending support rod 26, when the stall in which the work piece is contained is indexed and at rest at the work station. The brackets 21 and 23 are radially adjusted, and a railing 25 of the correct diameter is selected and mounted on the table 14*a*, such that the axis of the cylindrical work piece will be in registry with the axis of the rod 26 at the striping station. To provide coordination of the rotation and indexing of the dial 10 and raising the support rod 26, the driving mechanisms for these are coordinated, as subsequently explained.

Figure 2D:
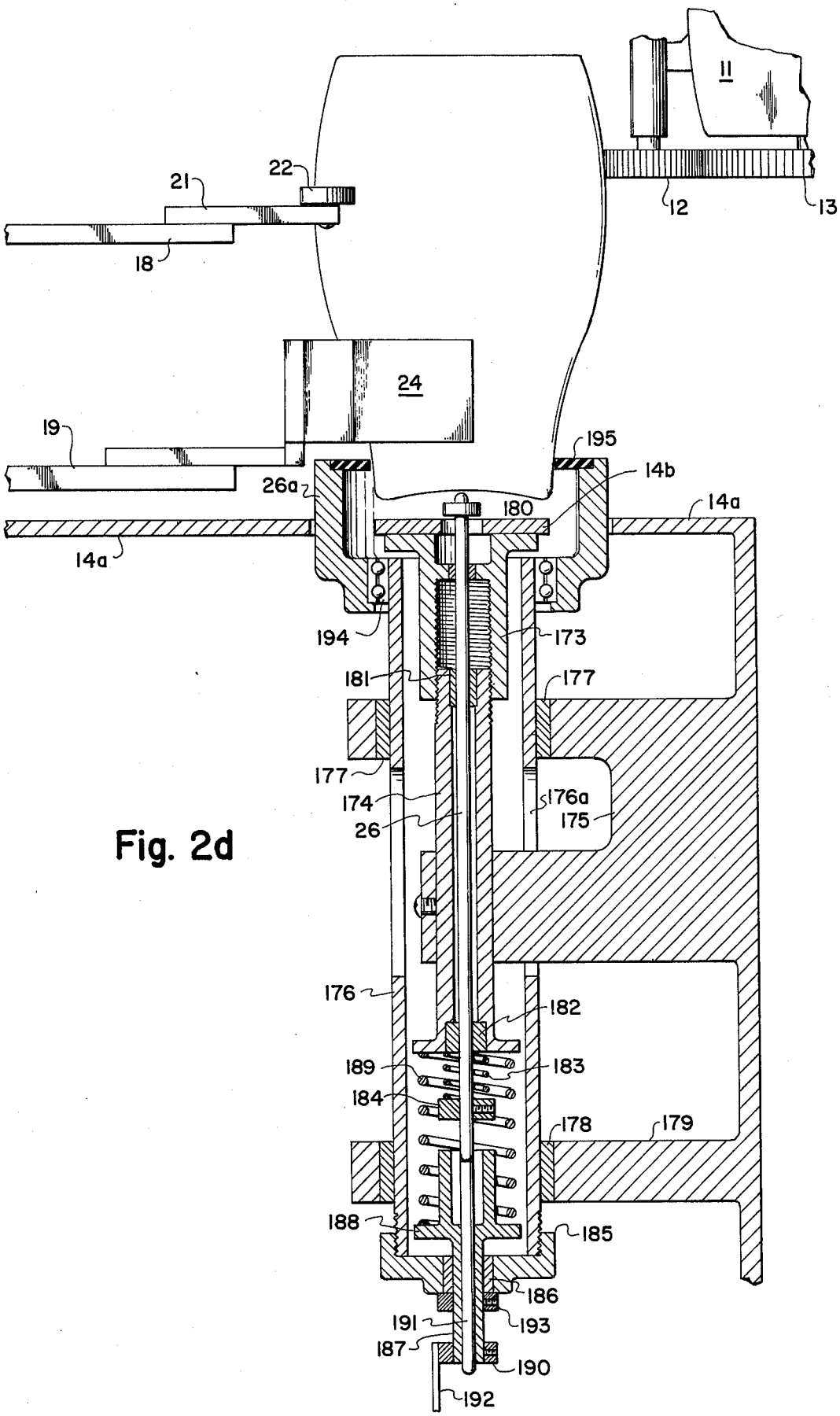

An alternate to the mechanism illustrated in FIG. 2 is shown in FIG. 2*d*, in which instead of the lower guide rollers 22*a*, a tumbler-base engaging chuck 26*a*, assembled to be raised into freely rotatable, tumbler engaging position by the same mechanism which raises the axial support rod 26, may be provided. This alternate is preferred particularly for striping tumblers of which the concave bottom surface, which rests on the rod 26, does not have its deepest point precisely on the central axis of the tumblers.

When the cylindrical work piece is raised at the striping station upon the axial supporting rod 26, it is free for substantially frictionless rotation against the guide rollers 22. The headmount mechanisms then swing the driving arms 16 to place the printing rollers 12 in tangential contact with the cylinder, moving the circumferential-striping head 11 laterally towards the side of the tumbler opposite the guide rollers 22 in a direction substantially along an extension of the dial radius, and lowering the rim-bending head 11a to the working positions illustrated in FIGS. 1 and 2.

The construction of the circumferential-striping head 11 will next be described.

Figure 3:
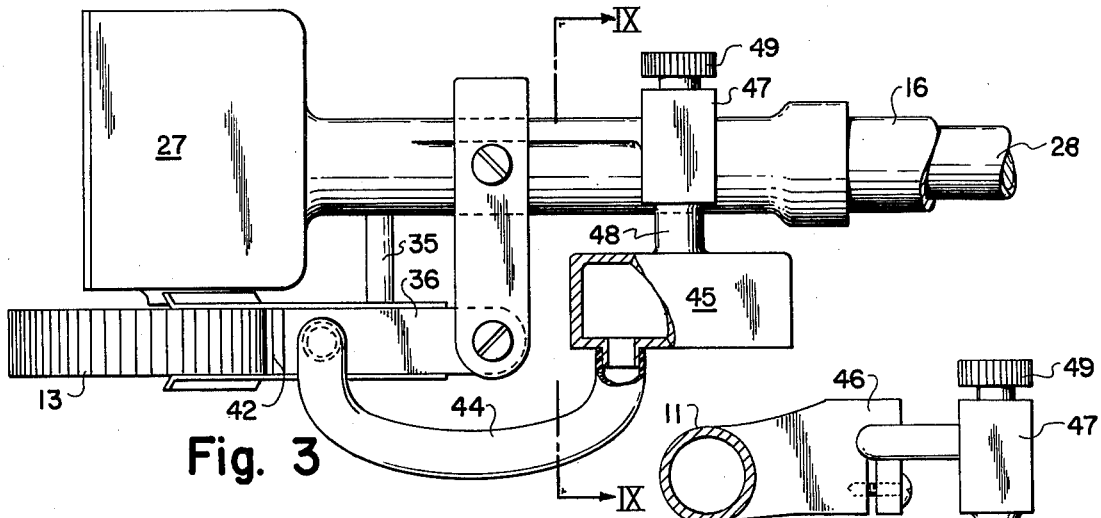
FIG. 3 is a side view of the circumferential-striping head of my applicator and FIG. 4 shows the same partially in vertical section.

The driving arm 16 is a tube which connects to a head housing 27, as shown in FIG. 3. This housing 27, at its forward end, includes a gear box as illustrated by the cross-sectional views, FIGS. 4 and 8, beginning with a journal box for the driving shaft 28, which extends through the tubular driving arm 16 to the rear of the headmount 15. On the forward end of the shaft 28 is mounted a bevel gear 29 which meshes with a bevel gear 30 on the applicator drum axle shaft 31. The applicator drum 13 is mounted on the lower end of the axle shaft 31 below the housing 27.

Figure 8:
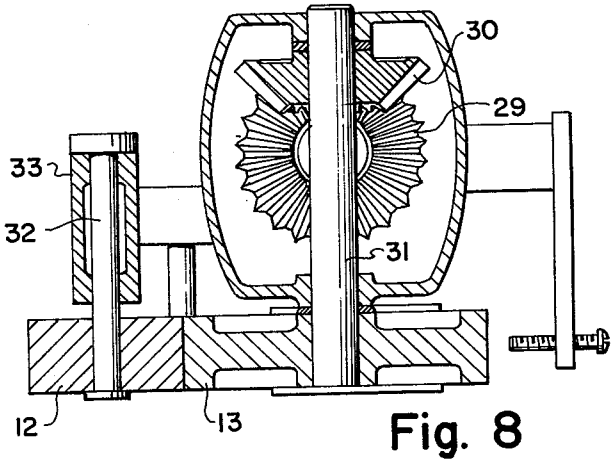
FIG. 8 is a section at the vertical plane indicated by VIII—VIII in FIG. 4.
Figure 5:
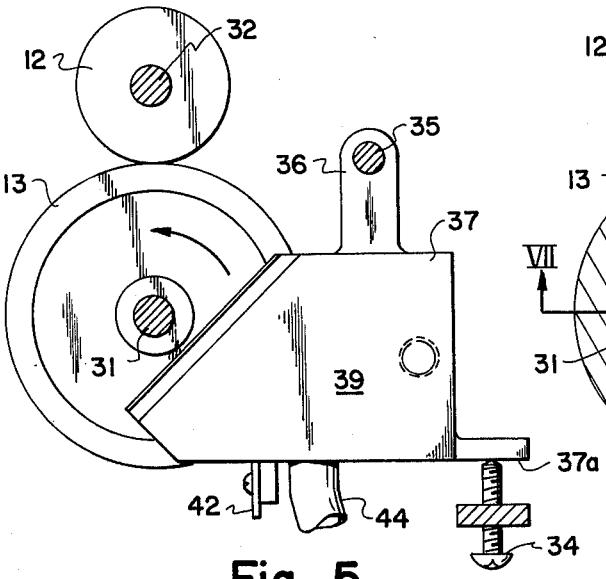
FIGS. 5 and 6 are horizontal sectional views at the planes indicated by V—V and VI—VI in FIG. 4, showing the striping roller, applicator drum and pigment applying reservoir of the circumferential-striping head.
Figure 6:
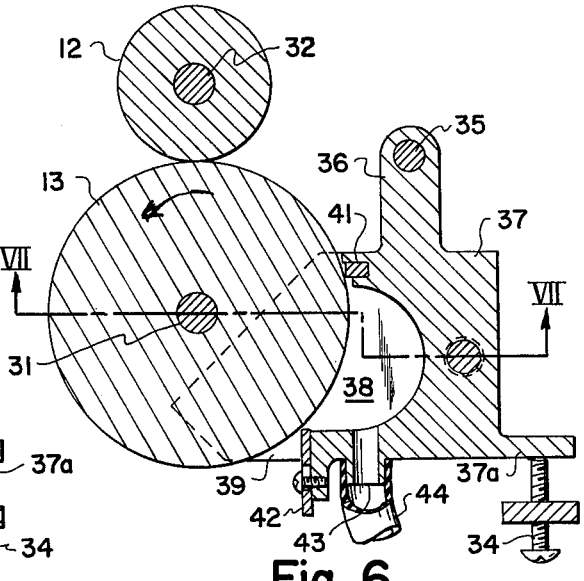

The stripe printing roller 12 bears against, and may be frictionally driven by contact with, the applicator drum 13, which is substantially larger in diameter, as illustrated in FIGS. 5, 6 and 8. The printing roller 12 rotates about an axle shaft 32 which is mounted at one end of, and extends below, an arm 33. Only the section of the arm 33 forming the journal box for the axle shaft 32 is illustrated in the accompanying drawing (FIG. 8). This arm 33 extends from the journal box a short distance parallel to the housing 27 and is pivotally connected thereto at its other end, and biased by means of a spring (not shown in the drawings) to maintain the printing roller 12 in contact with the applicator drum 13. This construction is similar to the mounting of the arm 26 in the Ryckman patent cited, col. 3, lines 14–20, and hence need not be illustrated in this disclosure.

Figure 4:
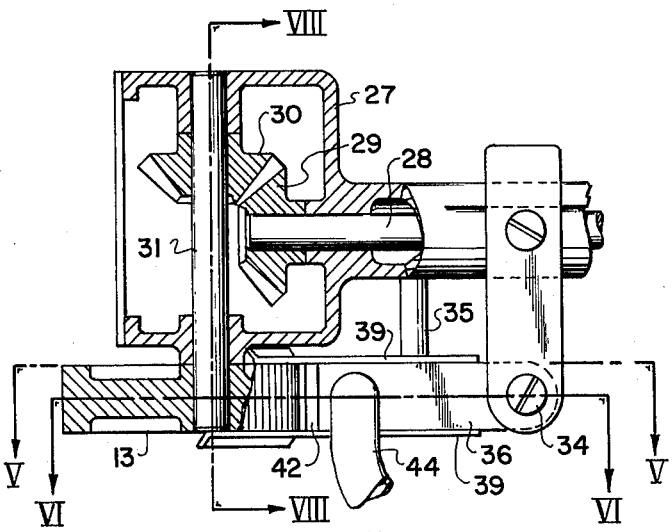

Below the housing 27 and pivotally supported thereby on a vertical axle rod 35 is a pigment reservoir block 36 which bears against a segment of the applicator drum 13 as illustrated in FIGS. 4, 5 and 6. The reservoir block 36 has a body portion 37 of the same width as the applicator drum 13. The pigment reservoir is formed by a pocket 38 in the block 37 adjacent a segment of the applicator drum 13, and face plates 39 lined with gaskets 40 which extend beyond the rim of the applicator drum 13 on both sides in sealing contact therewith. Thus only the peripheral rim portion of the drum segment is in contact with the pigment.

The end of the pocket 38 which is on the printing roller side, in the direction of rotation of the applicator drum 13 as shown by the arrow in FIG. 6, has a color thickening blade 41 spaced from the drum 13 by the distance of the thickness of the pigment coating to be removed by the drum 13, thus forming the outlet from the pocket 38. The blade 41 is preferably a bar of tungsten carbide which is soldered to the block 37. The spacing between the blade 41 and the drum 13 is set by adjusting screw 34 which bears against a tab 37*a* on the block 37. At the opposite end of the pocket 38 a sealing blade 42 is adjustably mounted on the block 37 between the lateral gaskets 40. This blade 42 is adjusted such that it will not scrape residual pigment from the applicator drum 13 as it enters the reservoir, but just to contact the surface of the residual pigment so as to prevent outward flow from the reservoir at this point.

Figure 9:
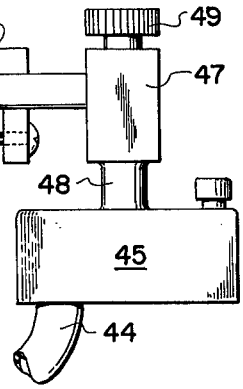
FIG. 9 is a section at the vertical plane indicated by IX—IX in FIG. 3.
Figure 9A:
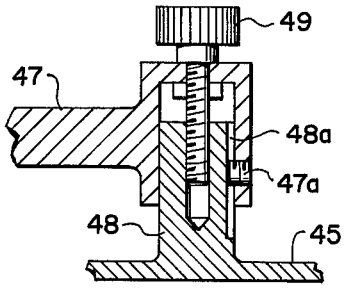
FIG. 9a is a section through the vertical axis of the adjusting screw 49 in FIG. 9.

Behind the blade-connecting bracket on the body portion 37 is a filling tube 43 from the pocket 38 and extending a short distance outside the body portion for connection of one end of a supply hose 44. The other end of the hose 44 is connected to a supply tank 45 which is adjustably mounted on the side of the housing 27 as illustrated in FIGS. 3, 9 and 9*a*. This mounting includes a clamping bracket 46 extending from the housing 27 to which is fastened a vertical adjustment support sleeve 47, bored to receive a shaft 48 extending upwardly from, and integral with the supply tank 45. To prevent rotation of the shaft in the sleeve, a keyway 48a is cut along the shaft 48 into which fits a guide pin 47a extending into, and held by threaded engagement with, the sleeve 47. The shaft 48 has an axial threaded hole from the top thereof to receive an adjusting screw 49 extending through the top of the sleeve 47, whereby the reservoir may be raised or lowered. By this means the supply tank 45 may be vertically adjusted with respect to the reservoir block 36 to the level desired for gravity flow.

The gravity-flow system for pigment above described is the one which the applicant prefers, but other pigment supply devices may be used. In an experimental installation, the applicant has also successfully used a squeeze-bottle indicated at 45*a* in FIG. 1, to contain the pigment supply, whereby the operator maintains the reservoir sufficiently full by periodically squeezing the bottle 45*a*.

The construction and operation of the dial 10 and associated components will now be more particularly described. Referring first of FIG. 2, the upper dial plate 18 is vertically adjustable on the shaft 20 by means of an axial adjusting screw 50, nut 51 and cap 52 which extends upwardly from, and is connected to, the hub of the dial plate 18. This hub is axially movable along the shaft 20 but rotatable therewith by a longitudinal kay engaging keyways machined in the shaft 20 and the hub of the dial plate 18, which are not illustrated in FIG. 2 as such construction is conventional and well known in the art. The lower end of the adjusting screw 50 engages an axial, threaded hole at the top of the shaft. This screw extends upwardly through plain (not threaded) bores in the top cross bars of the cap 52, between which cross bars the adjusting nut 51 fits neatly on both sides. Thus by rotating the nut 51 the upper dial plate 18 may be vertically adjusted to place the guide rollers at the desired level.

FIGS. 10 and 11 illustrate the radially adjustable mounting of the guide roller brackets 21 on upper dial plate 18. The brackets 21 have two inwardly extending bars, one each on each side of a radial bar 21*a* attached to the top of dial plate 18, and are held in adjusted position by a clamping yoke 21*b* and set screw 21*c*.

FIGS. 12 and 13 illustrate the vertical, radial and lateral width adjustment of the stall brackets on the lower dial plate 19. The radial support bracket 23 is formed by two parallel bars 23*a* integral with, at the forward end, an upstanding bar 23*b*. The bars 23*a* are on opposite sides of a radial bar 23*c* attached to the top of dial plate 19, and are held in adjusted position by clamp bar 23*d* and screw 23*e*. The stalls 24 are formed at the back by two parallel bars 24*a* secured at their center to a block 24*b* which is bored to receive the upstanding bar 23*b*, on which it is held in vertically adjusted position by a set screw 24*c*. The sides of the stalls are formed by L-shaped brackets 24*d*, one leg of which abuts the bars 24*a*, and on which leg is a key bar 24*e* fitting neatly between the bars 24*a*. A threaded hole is provided in this leg and its key bar 24*e*, to receive the screws 24*f* by which the sides 24*d* may be secured in desired adjusted position.

The means for raising the axial work support rod 26 at the priinting station provided in the illustrated example of my invention will next be described.

Referring first to the FIG. 2 example, the rod 26 is alligned vertically by a bearing block 53 in the table 14*a* below the dial plate 19, and a bearing bracket 54 some distance below the table 14a. Between these, on the rod 26 are mounted a pair of disks 55, spaced apart for a distance matching the diameter of a roller 56. This roller 56 is rotatably mounted at one end of a lever 57 extending generally transversely to the axis of the support rod 26, with the roller 56 between the pair of disks 55, to a fulcrum 58. Pivoted to the lever 57, between the roller 56 and fulcrum 58, is a roller 59 which rests on a cam 60. As seen in FIG. 2*b*, rotation of the cam 60 which is mounted on a shaft 61 raises or lowers the roller 59, thus rocking the lever 57 about the fulcrum 58 to raise or lower the rod 26, shown in raised position in the drawing.

The lower end of the rod 26 extends below the lower bearing block 54 and, adjustably attached thereto, is a bar 165 which extends laterally through a slot in the housing wall and is connected at its outer end to a vertically-extending rod 166 which terminates in a yoke bar 167 (of which one end view only is seen in the drawing), on the ends of which are journalled links 168 connected to parallel levers 169 fulcrumed at 170 on bracket 171. The upper ends of the two levers 169 are pivotally connected to the sides of a guide-roller support block 21*d*, which is also pivotally mounted on two links 172 parallel to the levers 169. The bracket 171, support block 21*d*, levers 169 and links 172 thus form a parallelogram such that rocking the levers 169 by the rod 166 and yoke 167 moves the block 21*d* towards and away from the base of the work piece, such that when the rod 26 is raised the guide rollers 22*a* are brought to bear against the side of the tumblers, and when the rod 26 is lowered, the rollers 22*a* are retracted from the tumblers.

In the alternate illustrated by FIG. 2*d*, the table 14*a* has an opening at the work station large enough to receive and guide the outside cylindrical surface of the chuck 26*a*, the top of which, when lowered, is flush with the top of the table 14*a*. Inside the chuck, the top surface of the table is continued by a circular disk 14*b* having a central opening through which the work supporting rod 26 may rise to lift the work piece. The top of the chuck, and the top of the disk 14*b* thus provide a substantially flush continuation of the top of the table 14*a* when the chuck is lowered, over which the work piece may glide as it is moved to and from the stripe printing station by the dial 10.

Since the chuck 26*a* must be vertically movable outside the disk 14*b* and the central support rod 26 must be movable inside the disk 14*b*, the latter is supportably secured to the flange of a cap 173 at the top of an axial tube 174 secured to, and supported by, a bracket 175 extending from the side of the table. Coaxial with and outside the tube 174 is a chuck-support tube 176 mounted to glide vertically through a pair of guide sleeve-bearings, the upper one of which, 177, is mounted in an arm of bracket 175 and the lower one, 178, is mounted in a lower arm 179. Since the arm 175 supporting the tube 174 must extend through the chuck-support tube 176, that tube has a slot 176*a* through which the lower branch of the arm 175 extends. The sides of the slot 176*a* slidably engage the side of the lower arm of the bracket 175 so that the tube 176 is free to move up and down without rotation. The work support tube 26 glides up and down through three aligned bearings, the upper one, 180, being held in the cap 173, the other two, 181 and 182, being at the top and bottom of the tube 174. The rod 26 in this embodiment extends below the lower end of the tube 174 and is biased towards rest position with its top below the ring 14*b*, by means of a helical compression spring 183 between the bottom of tube 174 and a collar 184 secured to the rod 26.

The lower end of the chuck-support tube 176 is closed by a cap 185 at the center of which is a sleeve-bearing 186. This bearing 186 axially guides a chuck and support rod raising sleeve 187 having a flange 188 against which bears a helical compression spring 189, outside the spring 183. The upper end of the spring 189 rests against the base of the tube 174, and biases the sleeve 187 towards a lower rest position with the flange 188 against the flange 185 and urging the tube 176 to lower the chuck 26*a* flush at the top with the top of table 14*a*. Axially within the sleeve 187, in line with the rod 26, is secured by a set screw 190 a rod 191. When the mechanism is in work supporting position, as illustrated in FIG. 2*d*, the top of the rod 191 engages and lifts the work supporting rod 26 into its work supporting position. Secured to the base of the sleeve 187 is a bar 192 which engages the roller 56 (FIGS. 2*a* and 2*b*) and is thus raised or lowered by the cam mechanism previously described. When raised, a collar 193 on the sleeve 187 abuts against and lifts the chuck supporting tube 176 into the position illustrated in FIG. 2*d*.

The chuck 26*a* is rotatably mounted in the upper end of the tube 176 on anti-friction bearings 194. The chuck is comprised of a resilient ring 195 of inside diameter substantially that of the tumblers at the zone of contact with the ring 195, mounted in a notch at the top of a chuck sleeve long enough to avoid abutment of the top of the tube 176 against the top flange of the cap 173 when the chuck is raised into work engaging position. The ring 195 may be secured to the sleeve by means of one or more screws (not shown in the drawing).

This operation is coordinated with the operation of the dial 10 by the drive illustrated in FIGS. 2, 2*a* and 2*c*. Power from a motor 62 is transmitted by motor pulley 63, belt 64 and pulley 65 to a transmission gearing 66 having a vertical output bevel gear 67 at the top and Geneva gear driving wheel 68 at the bottom. Meshing with the bevel gear 67 is another bevel gear 69 on the cam shaft 61. The Geneva gear driving wheel 68 drives intermittently a Geneva wheel 70 (FIG. 2*c*). The Geneva Wheel 70 is mounted on a vertical shaft 71 on which is also mounted a gear 72 which meshes with gear 73 mounted on the dial shaft 20. In the particular embodiment illustrated, the Geneva wheel 70 with four radial slots rotates 90° with each revolution of the gears 67 and 68. The dial 10 is shown with stalls at 60° spacing, and the gears 72 and 73 would be proportioned with a 2:3 ratio to have 90° rotation of the Geneva wheel effect 60° rotation of the dial 10. The bevel gears 67 and 69 are identical, effecting one revolution of the cam shaft 61 for each 60° rotation of the indexing dial 10, thus coordinating the indexing steps with the raising of the supporting rod 26 by the cam 60.

The Geneva gearing for intermittent rotation of the dial 10 is the type which I prefer to use, but any of the other well known intermittent driving systems, such as, for example, the intermittent mechanism 376 in Cummings U.S. Pat. No. 3,525,303 issued Aug. 25, 1970 entitled Apparatus for Decorating Pottery, for operating a chuck-carrying turntable.

When striping is to be performed at more than one position, as at A and B in FIG. 1*a*, a work piece raising rod 26 would, of course, be provided at each of these positions. Thus, for the two-position embodiment of my invention illustrated diagrammatically in FIG. 1*a*, a lever 57 and cam 60 would be installed substantially as described above for position A. In addition, a second lever 57, longer than the first so as to extend from a fulcrum 58 to position B, would be provided, and a second cam 60 would be mounted on the cam shaft 61 to raise and lower this second lever 57. The contour of the second cam 60 would be made to move this second lever 57, at its rod-engaging end at position B, through the same vertical distance as the first lever, so that the two tumblers at both positions A and B would be lifted above the table 14*a* to the same indexed elevation for striping. Also, to provide selection by the operator of either 60° or 120° rotation of the dial 10, an additional pair of gears 72 and 73 would be included in the transmission from the Geneva wheel 70, this additional pair having a 4:3 ratio, and a gear shift operable from outside would be added to change from one pair of gears 73, 74 to the other pair. These construction variations involve only well known mechanical engineering and therfore do not need illustrations.

The headmount 15 in the panel 14 for operating the circumferential-striping head 11 will now be described. This is constructed to support and guide the movement of the driving are 16 at a location substantially remote from the printing station where the work pieces are striped, and to provide adjustment of the head 11 vertically and angularly such that the printing roller 12 will contact the work piece tangentially to the cylindrical surface at the desired distance from its rim. In FIG. 2 the work piece is illustrated as having its side substantially vertical, axially, at the striping zone and the printing roller 12 is therefore horizontal, i.e., perpendicular to that surface. Most work pieces, however, will have a surface somewhat inclined to the vertical axis at that zone and the striping head would be adjusted with the printing roller correspondingly inclined to the horizontal, and the headmount is constructed to provide a substantial range of such adjustment.

As illustrated in FIGS. 14, 15 and 16, the headmount assembly 15 for the circumferential-striping head is constructed of six major components. These are, first, a mounting plate 74 which is framed at the top and bottom in the vertical panel 14, at a selected, adjustable location therein. The mounting plate 74 has two beveled side rails 75 along its sides, a horizontally extending bracket 76 near its top, and a generally central opening 77 between the side rails 75, as most clearly seen in FIG. 19. Inserted within the side rails 75 is the next major component, namely, a driving arm support plate 78, having beveled edges fitting the bevel of the side rails 75, a driving arm support hub 79, a position adjusting bracket 80 at the top, and an arc-shaped slot 81. A bolt 82 threadably held in the bracket 76 adjustably connects the latter to the bracket 80 whereby the plate 78 may be raised or lowered as required. The third major component is a mounting plate 83, the lower part of which is a clamp 84 made to fit and be clamped around the hub 79 by means of the transverse bolt 85. The upper part of the mounting plate 84 has a push-pin guide hub 86 opposite the curved slot 81 and a forwardly extending bracket 87.

The fourth major component is a carriage frame 88, of which a vertical cross section appears in FIG. 15.

The carriage frame 88 is a rectangular frame having two parallel sides 89 extending downwardly from each end of an angle shaped top member 90 which rests upon the mounting clamp to which it is secured by the screw 91. The frame is divided by transverse bars 92 and 93 into three sections or windows, and through the uppermost of these the push-rod hub 86 extends. The central window forms the frame for a universal pivot mounting for the end of the driving arm 16, consisting of a turret 94 pivoted about its vertical axis between two pivots adjustable between adjusting screws 95 at the center of the bars 92, 93 and resting on thrust bearings 96 in the two horizontal sides of the turret 94. The bottom window between the lower bar 93 and the bottom bar 94 frames the hinge for the fifth major component, namely a forwardly extending yoke 97 which supports and guides the motion of the driving arm 16 as it is brought into or removed from operating position shown in FIG. 1. This hinge may conveniently be a pair of studs 98 which engage the inner races of anti-friction thrust bearings 99 at the end of a hinge bracket 100 which constitutes the bottom portion of the yoke 97.

The driving arm 16 terminates at the headmount in a bearing block 101 which passes through the turret 94 and is pivoted thereto about a horizontal axis by means of anti-friction thrust bearings 102 and adjusting screws 103. To facilitate assembly and adjustment, these screws extend through sleeves 104 from the turret and beyond the sides 89 through openings 105, where the nuts 106 bear against the outside rims of the sleeves 104. The drive shaft 28 is rotatably supported in an anti-friction bearing (not shown in the drawings) within the bearing block 101 and terminates in an universal joint 107 connecting it to the headmount drive, as subsequently described.

The fifth major component of the headmount is the yoke 97 pivoted at the base of the carriage frame 88 as previously described. The yoke 97 has a bottom section 108 which extends forwardly from the bearings 99, to a flange 108*a* at which a driving-arm support track 109 is attached. On each side, extending upwardly and forwardly from the section 108, the yoke has a bar 110, the two bars 110 being connected together at the top by a transverse angle 111. The yoke 97 is biased to rotate clockwise, as seen in FIG. 14, about the pivots 99, by means of a tension spring 112 connected between the angle 111 and the yoke and the angle 90 in the carriage frame. Below the angle 111, connected to both bars 110, is a bracket 113 at the center of which is an adjusting screw 114, the end of which bears against a stop plate 115 at the base of the angle 90 when the yoke is in fully raised position by tension of the spring 112.

The sixth major component of the headmount is an L-shaped lever 116 controlling the horizontal rotation of the driving arm about the yoke bearings 96. The lever 116 has a laterally extending arm 117 and a forwardly extending arm 118, joined at a fulcrum hub 119. The hub 119 is mounted on a hinge bracket 120, connected by screws to the side of the carriage frame 88 and terminating in a vertically extending hinge pin 121 extending upwardly through the hub 119. A collar 122 is fastened to the end of the hinge pin 121 above the hub 119. The lever arm 117 extends to a point just ahead of the push-pin guide hub 86 on the mounting plate 83, and the lever arm 118 extends outside and somewhat beyond the forward end of the yoke 97. The lever 116 is biased to rotate counterclockwise, as seen in FIG. 16, by a tension spring 123 connected at one end to the arm 118 and at the other end to a bracket 124 on arm 110 of the yoke 97 on the opposide side of the headmount. An adjusting screw 125 in the arm 118 positioned to contact the adjacent arm 110 provides a stop to limit such counterclockwise rotation. Extending laterally from the end of the lever arm 118 is a bar 126. The bar 126 extends through a slot 127*a* in the upstanding leg of a generally angle shaped steering bracket 127, and thence axially through a helical compression spring 128 which bears at one end against the steering bracket 127 and at the other end against a spring seat 129 mounted on the end of the bar 126. Behind the slotted upstanding leg of steering bracket 127, on the bar 126 is an adjustable collar 130 which determines the maximum extension of the spring 128 and the initial position of the bracket 127 with respect to the lever arm 118. The steering bracket 127 has a generally horizontally extending leg terminating in a driving arm connecting collar 127*b* which fits around the driving arm 16 and is secured in adjusted position thereon by a set screw 127*c*.

Thus, when the lever 116 is rotated about the fulcrum 119, it moves steering bracket 127 generally horizontally, which in turn rotates the steering arm about the generally vertical axis pivot bearings 96 in the turret 94. The slot 127*a* in the vertical leg of the steering bracket 127 provides for substantial changes in the vertical position of the collar 127*b* with respect to the lever 118. On the steering arm 16, just behind the steering bracket collar 127*b*, a roller 131 is mounted which rests upon the track 109 mounted on the yoke 97 as previously mentioned. The roller 131 may be a ball bearing of which the inner race is mounted on the arm 16, the outer race resting on the track. As illustrated in FIG. 20, the track 109 is secured to the flange 108 of the yoke 97 by two bolts 132, the lower one of which passes through a straight bore in the track 109 and the upper one of which passes through an arc-shaped slot 109*a* in the track providing angular adjustment of the track surface to guide the lateral motion of the arm 16 towards and away from the work piece in the precisely correct direction, as it is moved by the lever 116.

From behind the mounting plate, and extending through the guide-hub 86 on the clamp 83 towards the arm 117 of the lever 116, is a push-pin 133. When this is thrust axially forward, its front end bears against the arm 117 and rotates the lever 116 about the fulcrum 119 to rotate the arm 16 in the direction moving the circumferential-striping head towards the indexed work piece, and bringing the stripping roller 12 thereof to bear against the work piece. The rotation of the lever 116 has a slight overtravel beyond this position of the arm 16, during which the rod 126 slides laterally through the steering bracket 127, the overtravel being taken up by shortening of the spring 128 and slight movement of the collar 130 away from the steering bracket. Thus the spring 128 provides the contact pressure of the striping roller 12 against the work piece, and the size and adjustment of the spring is made accordingly. The thrust of the push-pin 133 is reversed at the end of the striping operation, and the tension spring 123 then rotates the lever 116 to move the arm 16 and circumferential-striping head 11 away from the work piece, back to its original position.

The raising and lowering of the rim-banding head 11*a* is also actuated by a push-pin 133 in the headmount. The headmount for the rim-banding head is similar to, but not as intricate as, the headmount for the circumferential striping head, and the lever such as 116 with the associated components, including a track and roller such as 109 and 131, are not required. The driving arm 16 for the rim-banding applicator is suspended directly from the top of a headmount yoke similar to the yoke 97 previously described, by a tension spring 134 (see FIG. 1). The push-pin 133 in this headmount engages a bracket (not shown in the drawings) on this yoke to rotate it about the horizontal axis of a headmount turret essentially like the turret 94 previously described, against the tension of spring 112 which is deflected as the yoke rotates. This lowers the arm 16 with the rim-banding head 11*a* to the rim of the tumbler in indexed position. Slight overtravel of the headmount yoke is provided, permitting the rim-banding roller 12 to bear against the tumbler rim. Most of the weight of the headmount 11*a* and driving arm 16 is carried by the tension spring 134, which is selected and adjusted to provide the optimum bearing pressure of the roller 12 against the rim of the tumbler.

The two push-pins 133 are thrust forward in the headmounts simultaneously by the mechanism behind the front panel 14. An example of this apparatus is illustrated in FIGS. 21, 22 and 23. This consists of a rocking yoke 135 mounted behind the panel 14 so as to extend across substantially the entire length of the panel 14 and pivoted at each end on hinges comprised of brackets 136 and hinge pins 137. The longitudinally extending portion of the yoke 135 is rocked back and forth about the hinge pins 137, the back of the channel 138 pushes the push rods 133 forward or allows them to move back under the action of the springs 123 or 112, as described above. By having the channel section 138 extend the full length of the panel 14, the headmounts may be mounted at any selected position across the panel 14 and yet be operated by the rocking yoke 135 at all such positions.

The rocking yoke 135 is deflected forwardly by the action of a cam wheel 139 against the segments of a cam 140 attached to channel 138. The cam wheel 139 has a circle of sockets 141 adjacent its circumference by which cam engaging rollers 142 may be placed in any selected position, thus engaging and deflecting the cam in predetermined order as the cam wheel 139 makes a revolution. In the particular embodiment illustrated by FIGS. 21 and 22, three rollers 142 would be installed on the wheel 139. FIGS. 21 and 22 show the wheel in position deflecting the channel section 135 against the push-rods 133 to their extreme position, which brings the circumferential-striping head 11 and rim-banding head 11*a* to the operating positions illustrated in FIG. 1.

In this example the cam shaft is shown mounted on a shaft 143 supported on bearings (not shown) in the housing framework, on which shaft is also mounted a pulley 144. This is driven, by a belt 145, from a pulley 146 mounted on a shaft 147 below, on which is also a pulley 148. The pulley 148 in turn is driven by a belt 149, which extends forwardly to a pulley 150 on the cam shaft 61 (FIG. 23) for the tumbler lifting cam 60. This arrangement synchronizes the operations of the cam shafts 60 and 143 and thereby, also, the operation of raising a tumbler to free rotation at indexed position with the operation of bringing the printing heads in working position as illustrated in FIGS. 1 and 2.

The drive shafts 28 in the driving arms 16 are maintained under continuous rotation by a motor and transmission in the back of the housing, generally shown in FIG. 23, in which the support members are omitted for more clear illustration of the operating components. These are a motor 151 on the shaft of which is a pulley 152 engaging a belt 153 connected to a pulley 154 on the input side of a gear reducer 155. On the output side of the reducer 155 is a pulley 156 which through belt 157, drives a pulley 158 at the end of a transverse shaft 159 mounted on two bearing blocks 160. Two bevel gears 161 are shown on the shaft 159, which mesh with bevel gears 162 on forwardly extending shafts 163 rotating on bearings 164 adjacent their driven ends. These shafts 164 connect, through universal joints and shafts (not shown in the drawings), to the universal connections 107 (see FIG. 14) at the ends of the driving arm shafts 28.

The foregoing specifications describe one embodiment of my invention which renders it now possible to stripe cylinders in vertically erect position, by way of example, but my invention is not limited to this particular embodiment and admits of variation within the scope of the following claims.

I claim:

1. Apparatus of the type characterized by a stripe printing head mounted on the forward end of a tubular driving arm extending from, and pivotally supported by, a headmount generally remote from the printing head for applying circumferential stripes to the outside surface of cylindrical work pieces, said apparatus being constructed to operate on the work pieces with their cylindrical axes substantially vertical, comprising in combination a printing head including
- a housing,
- a printing roller,
- an applicator drum in operative contact with said printing roller and
- a pocket-type pigment reservoir block enclosing and confining a reservoir of pigment adjacent a segment of said applicator drum,
- said reservoir block being adjustably mounted on said housing to embrace said segment of said applicator drum on both sides and at both ends of said segment,
- means in sealed connection with said reservoir block for filling the same,
- applicator-drum drive gearing assembled within said housing.

a tubular driving arm rigidly connected at one end to said housing and supporting the same for movement of the printing head while maintaining the axes of said printing roller and applicator drum substantially vertical, a drive shaft extending through said tubular driving arm into said housing and connected at its end therein to said drive gearing in driving relation thereto, a headmount assembly remote from said printing head, said tubular driving arm being pivotably mounted in and supported by said headmount assembly, said headmount assembly including
1. a universal pivot engaging and supporting the end of said tubular driving arm,
2. a forwardly extending yoke pivotally mounted at its base for angular adjustment about a generally horizontal axis in said headmount,
3. a driving-arm guide track on said yoke below said driving arm and forward of said universal pivot,
4. a driving-arm positioning lever fulcrumed on said headmount and resiliently connected to said driving arm forward of said universal pivot to move said driving arm aong said guide track, said drive shaft extending through said tubular driving arm and beyond said headmount for connection to transmission shafts from a power source, and means operable from behind said headmount to rotate said driving-arm positioning lever fulcrumed on said headmount.

2. In printing heads for applying stripes of metallic or color pigments to cylindrical glass or ceramic articles, of the type having a stripe printing roller for rolling, printing contact with said articles, an applicator drum of substantially larger diameter than said stripe printing roller in pigment-applying and frictional-driving contact therewith, and a drum-coating pigment well along a segment of said applicator drum, the improvement consisting of a pocket-type enclosure for said well on all sides other than said segment and in fluid-confining relation with said drum from end-to-end and side-to-side of said segment of said drum such that only the peripheral portion thereof is in contact with the pigment within said pocket-type enclosure; pigment supply means mounted on said printing head adjacent said pocket-type enclosure, and a tubular conduit connecting said supply means to said enclosure for maintaining said enclosure filled with pigment; said stripe-printing roller and said applicator drum being the only rotatable components of said printing head which have contact with any pigment.

3. In printing apparatus for circumferentially striping cylindrical glass or ceramic work pieces rotatably mounted with their axes vertical, the improvement in printing head components thereof comprising:

a printing head housing constructed for connection to a conventional tubular driving arm, said housing including a terminal bearing for a drive shaft extending through said driving arm, a substantially vertical axle shaft rotatably mounted within said housing and extending below the bottom thereof, angle gearing arranged within said housing for operatively interconnecting said substantially vertical axle shaft to said drive shaft when said housing is mounted on said driving arm, an applicator drum mounted on said substantially vertical axle shaft below said housing, a stripe printing roller support bracket pivotally mounted on one side of said housing, and spring biased to rotate towards said one side, said bracket including a printing roller axle shaft parallel to the first-mentioned axle shaft, a stripe printing roller mounted on the lower end of said shaft, adjacent said applicator drum and held in tangential contact therewith by the spring bias of said bracket, a pigment reservoir block adjustably mounted on the bottom of said housing adjacent a segment of said applicator drum, said reservoir block being comprised of a body portion matching in thickness the width of said applicator drum and having a pocket for pigment on the side thereof adjacent said segment of said applicator drum, gasketed side plates on said body portion enclosing said pocket therein and embracing said segment of said applicator drum on both sides, a color-thickness control blade secured to said body portion, at the outlet side of said pocket, said blade being of the same width as said body portion and said applicator drum, means for adjusting the setting of said pigment reservoir block with respect to said applicator drum to vary the clearance between said color-thickness control blade and said drum, and thereby adjust the pigment thickness on said applicator drum, a sealing blade of the same width as said applicator drum and body portion, adjustably mounted on said body portion between said gasketed side plates at the applicator drum entry side of said pocket to seal said pocket against pigment outflow without wiping residual pigment from said applicator drum surface, thereby preventing leakage of pigment from said pocket;

a pigment supply port in said body portion;

a pigment supply container mounted adjacent to said reservoir block on said housing, a tubular conduit in sealed connection with said port in said reservoir block and said supply container whereby said pocket may be maintained filled with pigment.

4. Apparatus for circumferentially striping cylindrical work pieces such as glass tumblers or the like in automatic sequence at at least one striping station comprising a substantially horizontal table over which the work pieces may glide in vertically erect position a work-piece support member vertically reciprocatable from below said table at said striping station thereon whereby a work piece may be raised from said table for free rotation about its vertical axis at said striping station;

a rotatable dial adjacent the top of said table, said dial having a plurality of equally spaced peripheral work-piece stalls constructed and arranged to traverse said striping station by rotation of said dial, and deliver, and remove, said work pieces to and from, respectively, said striping station;

a tubular driving arm axially containing a printing head drive shaft and extending radially from a headmount structure remote from said dial in supporting, moving, driving, and angular adjusting relation to the stripe printing head next specified;

a stripe printing head mounted on the end of said tubular driving arm for generally horizontal movement towards and away from one side of a cylindrical work piece at said striping station by substantially lateral deflection of said driving arm actuated by said headmount, said head including a printing roller adjustable to tangentially contact work pieces by rotational adjustment of said tubular driving arm at said headmount;

means for rotating said dial intermittently to deliver and index work pieces in serial sequence to said (stripe printing) striping station; and synchronized driving means for itermittently rotating said dial, raising and lowering said work-piece support member, and moving said stripe-printing head by deflection of said driving arm at its headmount whereby work pieces are delivered to said striping station, circumferentially striped thereat, and removed therefrom in automatic sequence.

5. Apparatus as set forth in claim 4 further characterized by having two of said work-piece support members at adjacent positions spaced apart by the distance between the stalls of said dial and thereby providing two striping stations, two of said stripe printing heads mounted for operation at said two striping stations, said synchronized driving means including means for simultaneously operating said two work-piece supporting members and means for simultaneously moving said stripe printing heads.

6. Apparatus as set forth in claim 5 further characterized by said means for rotating said dial intermittently being operatively connected to said synchronized driving means by a shiftable transmission providing selective rotation of said dial through peripheral distances of one or two stall spacings on said dial.

7. An article of manufacture for use as a component of apparatus for striping circumferential bands on generally cylindrical work pieces of the class of ceramic or glass articles rotatably mounted at a work station with their axes substantially vertical, said article being comprised of an improved printing head including a housing, a pigment reservoir, and pigment application members comprising a printing head housing constructed for attachment to the end of a conventional tubular driving arm containing a conventional drive shaft, said housing including a terminal bearing for said drive shaft, aligned generally vertical bearings for an applicator drum shaft perpendicular to and adjacent the end of said drive shaft, a gear box about the intersection of the axes of said terminal bearings and said drive shaft and said aligned vertical bearings adapted to enclose angle gearing interconnecting said drive shaft and said applicator drum shaft when said article is installed for service, an applicator-drum shaft rotatably mounted in said aligned vertical bearings and extending below said housing, an applicator drum mounted on and secured to said applicator drum shaft below said housing, a pocket-type pigment reservoir block adjustably mounted at the base of said housing in fluid confining relation with a segment of said drum periphery on both sides and at both ends of said segment of said applicator drum, a stripe-printing-roller support bracket including a printing-roller axle with its axes parallel to the axis of said applicator-drum shaft, a printing roller mounted on said axle, said support bracket being pivotally mounted on one side of said housing placing said printing roller adjacent said applicator drum roller and spring biased to cause the circumference of said printing roller to rest against the circumference of said applicator drum.

* * * * *